US006661174B2

(12) United States Patent
Eastlund et al.

(10) Patent No.: US 6,661,174 B2
(45) Date of Patent: Dec. 9, 2003

(54) SAPPHIRE HIGH INTENSITY DISCHARGE PROJECTOR LAMP

(75) Inventors: Bernard J. Eastlund, La Jolla, CA (US); Maurice E. Levis, Hallieford, VA (US)

(73) Assignee: GEM Lighting LLC, Manakin-Sabot, VA (US)

( * ) Notice: Subject to any disclaimer, the term of this patent is extended or adjusted under 35 U.S.C. 154(b) by 0 days.

(21) Appl. No.: 09/969,903

(22) Filed: Oct. 2, 2001

(65) Prior Publication Data

US 2003/0034736 A1 Feb. 20, 2003

Related U.S. Application Data

(63) Continuation of application No. 09/241,011, filed on Feb. 1, 1999, now Pat. No. 6,414,436.

(51) Int. Cl.[7] ..... H01J 17/16

(52) U.S. Cl. ..... 313/634; 313/623; 313/493

(58) Field of Search ..... 313/493, 623, 313/624, 625, 626, 568, 634

(56) References Cited

U.S. PATENT DOCUMENTS

| | | | | |
|---|---|---|---|---|
| 3,608,050 A | | 9/1971 | Carman et al. | |
| 4,018,374 A | | 4/1977 | Lee et al. | |
| 4,501,993 A | | 2/1985 | Mueller et al. | |
| 4,855,879 A | | 8/1989 | Soltani et al. | |
| 4,965,484 A | * | 10/1990 | Fein | 313/15 |
| 5,075,587 A | | 12/1991 | Pabst et al. | |
| 5,239,230 A | | 8/1993 | Mathews et al. | |
| 5,404,076 A | | 4/1995 | Dolan et al. | |
| 5,424,608 A | | 6/1995 | Juengst et al. | |
| 5,424,609 A | * | 6/1995 | Geven et al. | 313/623 |
| 5,427,051 A | | 6/1995 | Maxwell et al. | |
| 5,451,553 A | | 9/1995 | Scott et al. | |
| 5,455,480 A | | 10/1995 | Bastian et al. | |
| 5,497,049 A | | 3/1996 | Fischer | |
| 5,540,182 A | | 7/1996 | Levinson et al. | |
| 5,588,992 A | * | 12/1996 | Scott et al. | 117/2 |
| 5,606,220 A | | 2/1997 | Dolan et al. | |
| 5,702,654 A | | 12/1997 | Chen et al. | |
| 5,808,398 A | * | 9/1998 | Stoffels et al. | 313/25 |
| 5,829,858 A | | 11/1998 | Levis et al. | |

OTHER PUBLICATIONS

S. Carleton et al., "Metal Halide Lamps with Ceramic Envelopes: A Breakthrough in Color Control," Journal of the Illuminating Engineering Society, Winter 1997, pp. 139–145.

S.A.R. Rigten, General Electric, Co. J. G.E.C. Journal, vol. 32, No. 1, 1965, pp. 50–51.

* cited by examiner

*Primary Examiner*—Frank G. Font
*Assistant Examiner*—Andrew H. Lee
(74) *Attorney, Agent, or Firm*—Fay Kaplun & Marcin, LLP

(57) ABSTRACT

A high intensity discharge lamp, especially for optical projection systems, in one embodiment uses an anode electrode, a cathode electrode and a cylindrical envelope of single crystal (SC) sapphire. The fill may contain hydrogen, chlorine, sodium, scandium, sulfur and selenium and is under pressure exceeding 20 atmospheres. The lamp produces a continuous non-flash arc and generates a correlated color temperature between 6500 and 7000 degrees Kelvin and an efficacy exceeding 60 lumens/watt.

7 Claims, 7 Drawing Sheets

$Tinnerwallsapphire_i = deltaT2_i + 273 \cdot K + Touterwall_i$ $Tmaxquartz_i = 1170 \cdot K$ $Tmaxsapphire_i = 1400 \cdot K$

SAPPHIRE / QUARTZ COMPARISON

| PROPERTIES | Units | Sapphire[1] | Alumina[2] | Quartz[3] |
|---|---|---|---|---|
| Softening Temperature | °C | 2030 | 2000 | 1597 |
| Maximum Operating Temperature | °C | 1400 | 1400 | 900 |
| Thermal Conductivity @ 600°K | W/cm°K | 0.189 | 0.035 | 0.017 |
| Expansion Coefficient @ 25-1100°C | m/m°K | $8.8 \times 10^{-5}$ | $8.3 \times 10^{-6}$ | $4.8 \times 10^{-7}$ |
| Tensile Strength @ 25°C [4] | psi | 155000 | NA | 7000 |
| Max Transmittance 0.3-0.9nm (1.0mm wall) | 1.0-100% | 0.98 (clear) | 0.84 (trans-luscent) | 0.94 (clear) |

[1] Single crystal alumina [2] Poly-crystalline alumina [3] Fused

[4] For tubes: Burst Pressure [ 2 X Wall Thickness X Tensile Strength @ Temp.] / Tube ID

TABLE 1

| Temperature | Tensile Strength Sapphire | Tensile Strength Quartz |
|---|---|---|
| 25°C | 155000 psi | 7000 psi |
| 500°C | 80000 psi | 16500 psi |
| 1000°C | 73000 psi | 24000 psi |
| 1400°C | 56000 psi | FAILURE |

FOR TUBES

Burst Pressure - (2 X Wall Thickness X Tensile Strength @ Temp)/ID

TABLE 2

THERMAL CONDUCTIVITY (W/CM·K)

| TEMP (°C) | SAPPHIRE | QUARTZ |
|---|---|---|
| 25 | 0.46 | 0.0138 |
| 800 | 0.17 | 0.018 |
| 1000 | 0.105 | 0.03 |

TABLE 3

SAPPHIRE HIGH INTENSITY DISCHARGE PROJECTOR LAMP

This application is continuation of application Ser. No. 09/241,011, filed Feb. 1, 1999 now U.S. Pat. No. 6,414,436.

FIELD OF THE INVENTION

This invention relates to optical projection lamps and more particularly to high intensity discharge (HID) electric lamps for optical projectors which lamps are presently generally constructed with quartz envelopes.

BACKGROUND

At the present time lamps (bulbs) for optical projectors are generally of the high intensity discharge (HID) type in which an arc is formed between two electrodes, the electrodes being positioned at opposite ends of a tubular envelope with a gap between them. The light from the lamp is reflected from a reflector and focused on an image gate, for example, an LCD (Liquid Crystal Display) plate, a slide projector film gate or motion picture film gate.

HID lamps presently have light transmissive lamp envelopes with quartz or ceramic (polycrystalline). Many lamp patent claims are based on benefits arising from specific forms of these materials. For example, in U.S. Pat. No. 4,501,993, relating to an electrodeless lamp bulb for producing deep ultraviolet (UV) "synthetic quartz which is substantially water free" is claimed as an advantage over "commercial quartz." In the article "Metal Halide Lamps with ceramic Envelopes: A Breakthrough in Color Control," *Journal of the Illuminating Engineering Society*, Winter, 1997, the advantages of translucent polycrystalline alumina ceramic envelopes over quartz envelopes are highlighted.

However, the light transmissive envelope technologies in present use have limitations which affect the ability of such lamps to provide long life, flicker-free operation, color stability and high efficacy.

The limitations quartz envelopes impose on HID lamp performance include the following:

1. The envelope structures are physically delicate and subject to breakage in handling;
2. Devitrification by water, and many different chemicals such as hydrogen and chlorine, limit the light output and the lifetime of electric lamps.
3. Sodium, neon and hydrogen diffuse out of the bulb and so they cannot be used for fills.
4. Pressure is limited by the tensile strength of 7000 lb/in^2 at room temperature.
5. Large temperature gradients occur across the bulb wall, limiting the heat transfer capability of the wall to about 20 watts/cm^2.

Despite these limitations, quartz envelopes are generally used because ceramic (polycrystalline) envelopes present greater limitations. The limitations imposed by ceramic (polycrystalline) walls include:

1. The ceramic is a translucent material which is unsuitable for optical systems.
2. The ceramic envelope is brittle.
3. Such ceramic envelopes have a relatively low tensile strength of less than 25,000 lb/in^2.

Lamp systems of quartz and ceramic (polycrystalline) envelopes have been in commercial use for many years and in most application areas, lamp performance has been optimized to the physical limits of these materials.

In some LCD (Liquid Crystal Display) projector electrode HID lamp applications it is desirable to have short (1–2 mm) arc gaps and 1–2 mm diameter for the light emitting volume. Such applications also need light emitting volumes that produce efficacy of 60 lumens/watt, or more, with good color stability, flicker-free operation and lifetimes of more than 2000 hours.

An example of a system maximized to the physical properties of quartz is described in Matthews et al U.S. Pat. No. 5,239,230. This patent describes the maximum performance capabilities of a short arc HID discharge lamp with a Mercury, Bromine, Xenon fill. The inner bulb diameter is limited to dimensions greater than 3.8 mm for power levels of 70 to 150 watts. Limitations are due to hoop stress limitations and temperature limitations, on the inner wall of the quartz tube, which result in melting of the inner bulb surface causing failure in less than 100 hours.

Another example of a system maximized to the physical properties of quartz is described in Fischer U.S. Pat. No. 5,497,049. This patent describes the maximum performance capabilities of a specific HID high-pressure mercury (over 200 bar) discharge quartz envelope design for LCD projectors having tungsten electrodes. Such a system suffers from premature failure due to devitrification and blackening of the inner bulb surface in the arc region and in the tip-off regions. Such lamps utilize bromine as an enhancer of efficacy but cannot use chlorine because of reactions with the envelope and cathode materials. The authors find the inner diameter of the bulb has to be greater than 3.8 mm for lamps in the 70–150 watt range to avoid premature failure due to the physical properties of the quartz.

Electrodeless lamps filled with sulfur and selenium have superior luminance properties. See, for example, U.S. Pat. No. 5,404,076 dated Apr. 4, 1995, and U.S. Pat. No. 5,606,220 dated Feb. 25, 1997. However, the envelopes are made of quartz, which has an operating temperature limitation of 900° C. For example, the "Light Drive 1000" lamps developed by/Fusion Lighting Inc. utilize quartz envelopes and require constant rotation at high rpm to avoid development of hot spots that create temperatures of over 900° C. If the rotation stops, the bulb blows up in about 3 seconds.

Lamp systems composed of ceramic (polycrystalline) material are translucent and are thus not usable for many optical systems applications. They are also brittle and have relatively low tensile strength. They do have advantageous features for lamp envelope applications in that they are chemically inert and impervious to elements like sodium, hydrogen, neon, chlorine, etc. For example, color stability and efficacy of over 90 lumens/watt of HID lamps with ceramic (polycrystalline) envelopes are described by Carleton et al in "Metal Halide Lamps With Ceramic Envelopes: A Breakthrough in Color Control", published in the *Journal of the Illuminating Engineering Society*, Winter, 1997.

Flash lamps, without continuous arcs, have been fabricated from single crystal (SC) sapphire by ILC Corporation of California and by Xenon Corporation of Massachusetts. SC sapphire is alumina (aluminum oxide) formed as a single crystal. These lamps have been demonstrated to have superior lifetime and color maintenance over quartz. The end seals of these commercial lamps utilize metal brazing materials and kovar components, which are unsuitable for HID lamp applications.

There are examples in the literature of seals to ceramic (polycrystalline alumina) tubing which have proven adequate for "double wall" containment vessels which have an outside envelope of quartz. For example, Juengst et al U.S. Pat. No. 5,424,608, Pabst et al U.S. Pat. No. 5,075,587, and Bastian U.S. Pat. No. 5,455,480 describe such sealing arrangements using a variety of glass sealing materials optimized for sealing to polycrystalline materials.

U.S. Pat. No. 5,702,654 relates to manufacture of single crystal sapphire for windows and domes. U.S. Pat. No. 4,018,374 relates to a sapphire-glass seal. U.S. Pat. No. 5,451,553 relates to thermal conversion of polycrystalline alumina to sapphire by heating to above 1100° C. and below 2050° C., and U.S. Pat. No. 3,608,050 relates to growing single crystal sapphire from a melt of alumina. The only mention we found in the patent literature of clear sapphire in a lamp is in a radio luminescent lamp application described in U.S. Pat. No. 4,855,879 in which clear sapphire planar window material is mentioned. The only mention we found in the technical literature is a diagnostic sodium discharge lamp described by S. A. R. Rigten, Gen. Elec. Co.J., Vol.32, p.37, 1965, in which a transparent sapphire tube is used for diagnostic purposes.

One of the difficulties in utilizing single crystal (SC) sapphire in commercial lamp construction is the difficulty in growing the cylindrical crystals with suitable concentricity and a crystalline structure free of defects. The above-mentioned patents and articles are incorporated by reference.

SUMMARY OF INVENTION

This invention significantly improves the efficacy, lifetime, and color stability of high intensity discharge (HID) lamps, especially projector lamps. It uses single crystal (SC) sapphire bulb envelopes which have physical properties superior to those of quartz and ceramic (polycrystalline) bulb envelopes. Its principal object is to provide a novel high intensity discharge (HID) lamp with a light transparent envelope of single crystal (SC) sapphire. The SC-sapphire HID lamp can be smaller, operate at higher power for equal size and be brighter with higher plasma luminance than quartz lamps with similar dimensions and fills. SC-sapphire HID lamps can also last four to five times longer with superior lumen maintenance. Such lamps may be easier to manufacture with superior manufacturing tolerances and at the same or lower cost as fused quartz envelopes, or polycrystalline alumina envelopes. These sapphire lamps use metal to ceramic seals that can tolerate temperatures up to 1300° C. as compared to fused quartz to metal seals that are limited to temperatures of about 250° C. The SC-sapphire HID lamp is preferably powered through two end electrodes or less preferably a combination of electrodes and microwave sources.

OBJECTS OF THE INVENTION

An object of the invention is to provide a novel sulfur or selenium-filled lamp with a light transparent envelope of single crystal (SC) sapphire.

Another object of the invention is to provide a novel method of sealing lamps having SC-sapphire envelopes in such a way that the lamps can contain light emitting gaseous substances with pressures as high as 600 atmospheres.

Another object of this invention is to provide a novel method of assembly of lamps with SC-sapphire envelopes in such a way that the manufacturing costs are low.

This invention will make possible a wide range of new lamps based on SC-sapphire envelopes with application in optical projectors. The lamp may also be used in automobile headlamps and home and general lighting applications.

Table 1 is a comparison of sapphire to quartz;

Table 2 is a comparison of tensile strength at various temperatures of quartz and sapphire; and Table 3 is a comparison of thermal conductivity between quartz and sapphire.

DETAILED DESCRIPTION OF THE INVENTION

Embodiments of this invention will be described in detail with reference to the accompanying drawings.

Figure 1A:
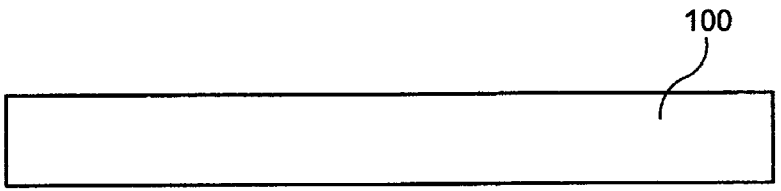
FIG. 1A is a top plan view of the (SC) sapphire lamp envelope.
Figure 1B:
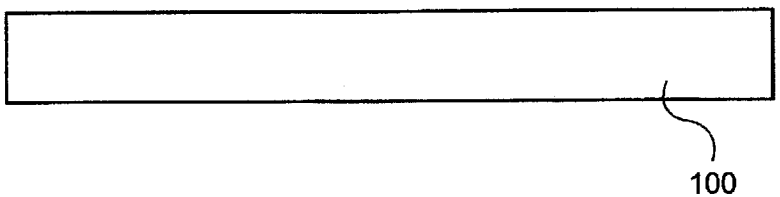
FIG. 1B is a side plan view of the bulb envelope of FIG. 1A.
Figure 1C:
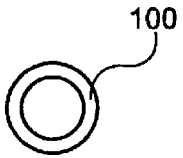
FIG. 1C is an end plan view of the bulb envelope of FIG. 1A.

FIG. 1A is a top view that shows an SC-sapphire lamp envelope hollow tube envelope 100. The ID designated d can range from 1 mm to more than 20 mm. The OD designated D of the SC-sapphire tubing can range from 2 mm to more than 23 mm. The length of the tube 100 designated L can range from 3 mm to more than 40 cm. Such raw SC tubing is commercially available from a number of corporations, such as Saphikon in New Hampshire, and Kyocera in Japan. However, it must be machined to obtain the desired concentricity.

Single crystal (SC) sapphire properties are compared with quartz and ceramic (polycrystalline alumina) in Table 1. The tensile strength of single crystal (SC) sapphire is compared with quartz as a function of temperature in Table 2. The thermal conductivity of single crystal (SC) sapphire is compared with quartz as a function of temperature in Table 3.

Sapphire is chemically inert and is insoluble in hydrofluoric, sulphuric and hydrochloric acid, and most important for HID lamp applications, it does not outgas or divitrify. It can be operated at higher temperatures than quartz and has significantly higher thermal conductivity. Raw SC tubing is presently available at reasonable prices from a number of vendors, such as Saphikon and Kyocera. Commercial and single crystal sapphire tubing, as delivered, has problems with holding circular cross-section tolerances. This can be taken care of by appropriate machining of the appropriate surfaces, i.e., reaming the interior and polishing the exterior using diamond tooling to obtain a uniform and specified wall thickness. A lamp envelope of SC-sapphire is capable of operating at a higher outer surface temperature than quartz and can handle conduction heat flux of greater than 150 watts/cm 2 compared to the 20 watts/cm^2 of quartz in HID lamp applications.

Figure 2A:
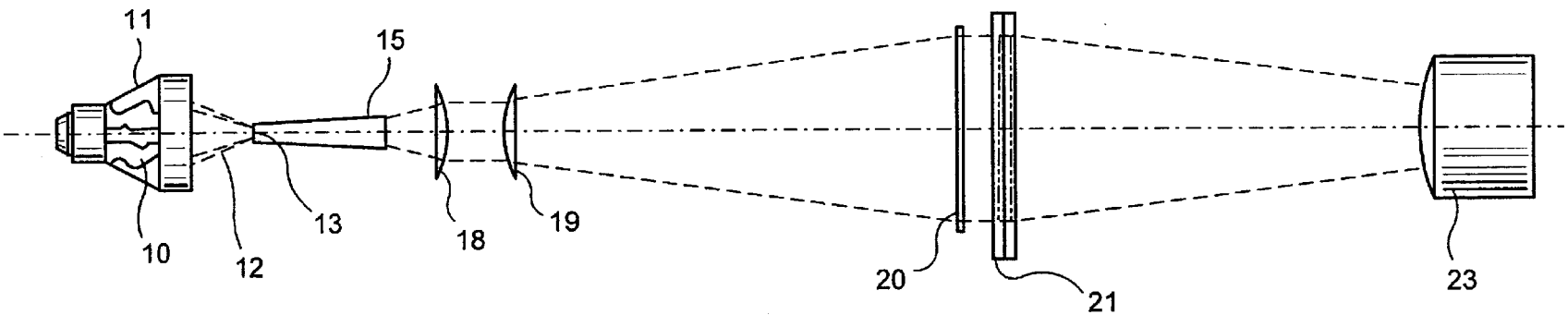
FIG. 2A is a side view of an LCD projector system using the (SC) sapphire bulb.

FIG. 2A shows an optical projection system in which an SC-sapphire lamp (bulb) 10 is with a reflector 11. The lamp's light is focused on the entry face 13 of a hollow light pipe 15, preferably of the type of U.S. Pat. No. 5,829,858 incorporated by reference. The beam is focused by lens 18 and lens 19 onto Fresnel plate 20 and LCD plate 21 which forms an image. That image is focused on the screen by projector lens 23.

Figure 2B:
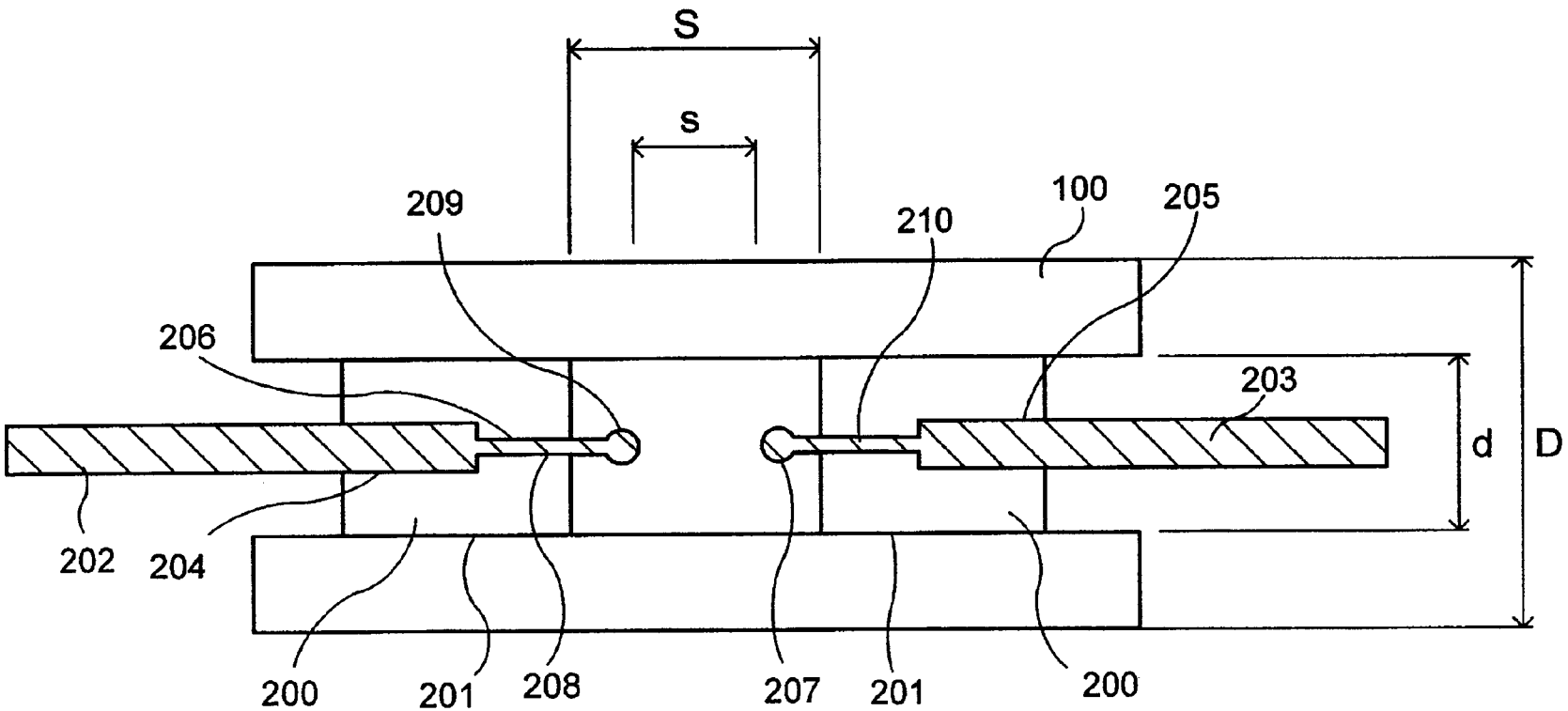
FIG. 2B is a cross-sectional view of the first embodiment of the bulb using electrodes.

FIG. 2B is a side view cross-section of a single crystal (SC) sapphire high intensity halide lamp. The sealing geometry is based on a design for sealing ceramic (polycrystalline) plugs to ceramic (polycrystalline) tubing as discussed by Juengst in U.S. Pat. No. 5,424,608. In the case of FIG. 2 a single crystal (SC) sapphire tube 100 is used. Plugs 200, which preferably are made of ceramic (polycrystalline) or single crystal (SC) sapphire, closes off the ends of the sapphire tube 100. The plugs 200 are sealed to the single crystal (SC) sapphire tube 100 to form a pressure and chemical resistant seal and contain the gases inside the region bounded by the inside diameter d and the surface facing the discharge of the plugs 200. The plugs are sealed to the single crystal (SC) sapphire tube 100 with halide resistant glass 202 to form a pressure and chemical resistant seal to contain the gases. The glass can be made from materials including aluminum, titanium or tungsten oxides as available from commercial vendors such as Ferro Inc. of Cleveland. The melting point of such materials is chosen to be about 800 to 1500 degrees Celsius, and most preferably about 1200 to 1400 degrees Celsius.

The cathode base 202 and the anode base 203 are fitted into the cathode base receptacle 204 and the anode base receptacle 205 with sufficient clearance for wetting by the fill glass via capillary action. The cathode base 202 and the anode base 203 are composed of niobium or tantalum, which have coefficients of expansion close to that of sapphire (8×10^−6 K^−1). The cathode stem 206 is attached to the cathode base 202 by welding. The cathode stem clearance hole 208 is sufficiently large to allow emplacement of the cathode stem with clearance too small to allow wetting of the clearance hole by glass through capillary action.

The anode end is similar to the cathode end. The filling of the discharge volume takes place prior to insertion of the cathode stem 206 and the anode stem 210. The spherical anode tip 207 and cathode tip 209 are formed after assembly by heating with lasers or by drawing high current through the discharge. After assembly, the glass seal is applied by melting glass into the space between the cathode base receptacle 204 and the cathode base 202.

This SC-sapphire halide lamp can be filled with a greater variety of halides and background gases than those fills which can be used in quartz lamps. For example, scandium and rare-earth halides can be used, with their favorite spectrum in the optical region. In quartz envelopes, such halides form reactions that lead to deposition of the silicon on the thoriated tungsten cathode and depletion of the scandium or rare earth fills. See, for example, Waymouth, J. F., "Electric Discharge Lamps," MIT Press, Cambridge, Mass., 1971.

Additionally, fills such as sulfur, sodium, hydrogen and chlorine can be used. The use of SC-sapphire envelopes, in combination with the various fills, more than doubles lamp efficacy to about 120 to 180 lumens per watt for arc gaps in the range of 1–2 mm. This improvement is due to increased plasma luminance. Lumen maintenance is improved dramatically and the life of the lamp is extended to four or five times that of fused quartz envelope lamps.

A short arc version of the lamp design in FIG. 2 is presented as an example. Lamps can match the optical systems of LCD projectors most favorably when the arc gap length s is on the order of 1–2 mm.

Short mercury arc HID lamps with quartz envelopes, which have been optimized to gap length s of 1.8 mm and inside diameter d of 3.8 mm with fill densities between 40 and 65 mg/cm^3 operating at 70 to 150 watts are limited to about 70 lumens/watt output and are subject to "flicker" and premature failure of the quartz envelope due to divitrification. (See, for example, Matthews et al, U.S. Pat. No. 5,239,230). Halide versions of such lamps are limited to about 70 lumens/watt with limitations due to the physical properties of the quartz envelope.

A mercury filled HID lamp is described by Fischer et al in U.S. Pat. No. 5,497,049. They find for example, with an inside diameter d of less than 3.8 mm and a power level of 70 to 150 watts, an outside diameter D of 9 mm and a pressure of 20 atm, the inside of the quartz begins to liquefy and devitrify leading to premature failure in less than 100 hours.

Quantitative analysis of the above-optimized quartz lamps is as follows:

The data for quartz from Table 2 and Table 3 are used to parameterize the temperature behavior of the thermal conductivity and the tensile strength of the materials. The geometry of the lamp and the input parameters of pressure, power and fill amount of Hg and Xe and other gases are taken from the Fischer et al patent. The temperature drop across the tube wall is calculated as follows:

$$\Delta T = qWT/k$$

where

ΔT=temperature drop between inner and outer wall q=heat flux in watts/cm^2

WT=wall thickness in cm k=thermal conductivity in watts/cmK

The total mechanical stress on the tube wall is determined by summing the thermal stress due to the temperature gradient and the mechanical hoop stress.

The thermal stress on the low temperature surface on the tube is given by:

$$\sigma(\text{thermal}) = \alpha E(T/2(1-)$$

where

α=coefficient of thermal expansion

E=Young's modulus

μ=Poisson's ratio

The Hoop Stress is given by:

$$\alpha(\text{Hoop}) = \text{Pressure } d/2WT$$

where Pressure=fill pressure

Using the following values:

WT=2.6 mm d=3.8 mm

L=5 mm

PWR=70 watts

Pressure=20 atmospheres

α=0.5*10^−6

E=11*10^6 lb/in^2 we find that when the outside wall temperature of the bulb is 25 degrees C. the inner wall temperature would be 1400 degrees K; which is consistent with their description of failure at that small size of d at 3.8 mm. Under those conditions the total stress on the bulb would be 53% of the maximum stress of 7000 lbs/in 2.

Comparison with SC-sapphire under the same conditions and with:

$\alpha=8\times10^{-6}$ $R=11\times10^{6}$ and an outer wall temperature of 25 C. gives an inner wall temperature of 331 degrees K with a total stress on the bulb of 3.9% of the maximum allowable stress.

Figure 3:
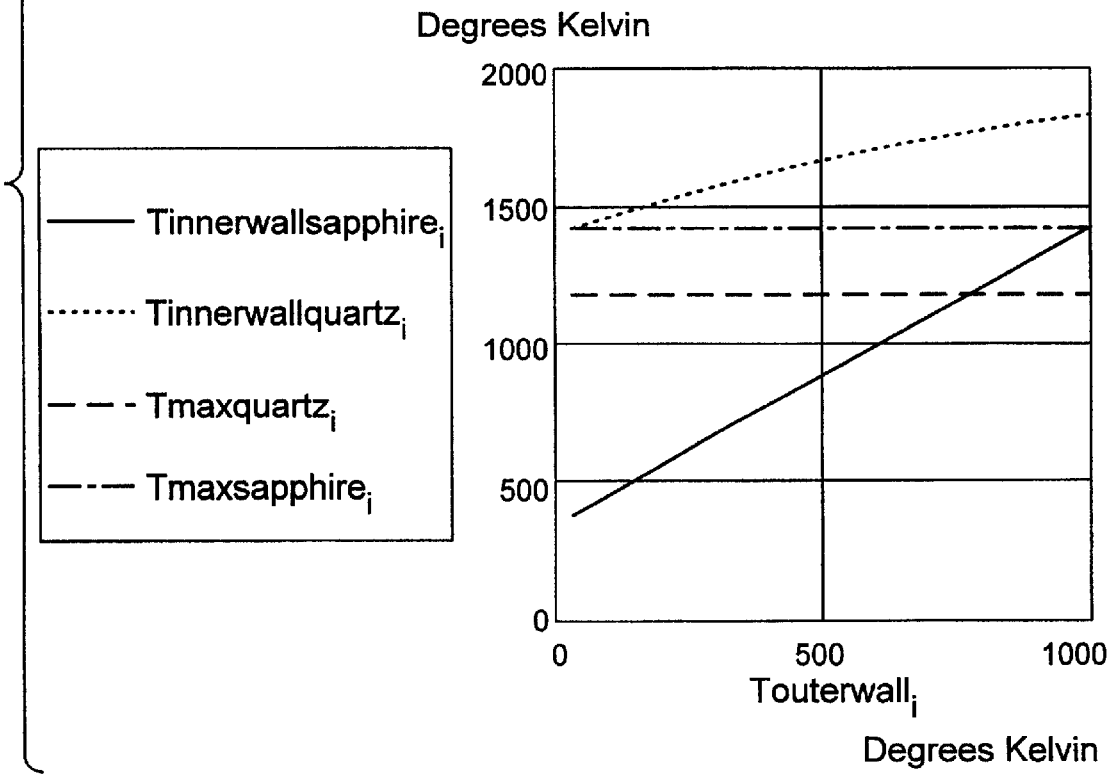
FIG. 3 is a chart comparing heat effect on quartz and (SC) sapphire walls.
Figure 4:
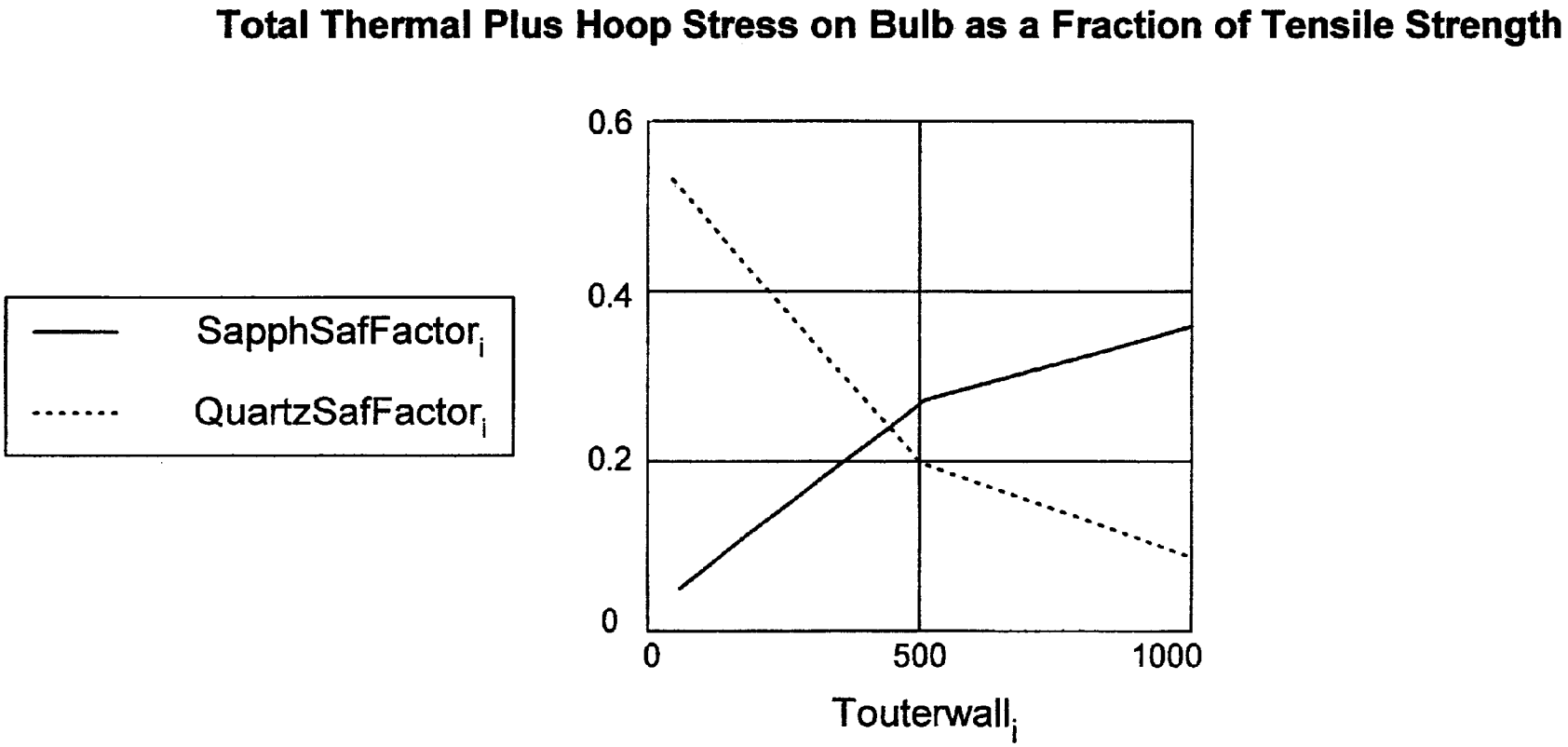
FIG. 4 is a chart showing stress on a bulb as a function of tensile strength.

The single crystal (SC) sapphire HID lamp is capable of being optimized with improved performance compared to quartz envelope HID lamps. FIG. 3 shows the inner wall temperature of quartz and single crystal (SC) sapphire envelope lamps compared as a function of the outerwall temperature. Note that up to 1273 degrees K the inner wall temperature stays within safe limits for the single crystal (SC) sapphire lamp, while the quartz lamp fails at room temperature. FIG. 4 is the safety factor defined as the actual total stress/maximum tensile strength. This factor should be a maximum of 0.3 to 0.4 for safe operation. Note that the quartz lamp would fail at room temperature, but that the sapphire lamp stays within feasible operating limits up to 1273 degrees K.

Improved efficacy of light output, with a gap sizes between 1 and 2 mm are desirable, especially in projector lamps. By allowing operation at higher fill pressures, the stronger single crystal (SC) sapphire tubing allows higher power density and thus higher efficacy. For example, the mercury HID quartz lamp described in Fischer et al above showed an increase in efficacy from 17 lumens/watt at pressures of about 20 atm to 70 lumens/watt at pressures of 50 atm, with roughly a square root dependence on pressure. Basically, increased pressure resulted in increased efficacy until the discharge went unstable.

The pressure at which the discharge goes unstable is determined by the Grashoft number:

$$Gr=c^{\pi 2}(d/2)^2(\text{pressure})^2$$

where pressure=mercury content in mg/cc (Note that 1 mg/cc of mercury is equivalent to 1 atm at 25° C.

In quartz HID lamps in this range Gr/c must be less than 1400 $mg^2$/cc for stable operation. It can be seen from this relationship that a lamp with the inner diameter d smaller than 3.8 mm would have a value of Gr/c greater than 1400 $mg^2$ and would be unstable at mercury contents greater than 60 mg/cc.

Single crystal (SC) sapphire envelopes, in the lamp design of FIG. 2, can prevent "flicker" at smaller diameters and much higher pressure. For example, a single crystal (SC) sapphire HID lamp we designate as SC1, with a value of d of 2 and an arc gap s of 1.4 mm and a chamber length S of 3 mm would have a value of Gr/c of less than 1400 for pressures of 120 to 135 mg/cc. This would result in flicker-free operation in this pressure range.

Efficacy is also much improved for SC1. Based on the increase in efficacy with pressure observed by Fischer, we extrapolate the performance of this 2 mm ID lamp to be in the range of 70 to 90 lumens/watt. Thus, improvements in efficacy into the range of 90 lumens/watt can be achieved with Hg fill lamps alone. Further increases of efficacy can be expected by filling the bulb with alternative elements such as sodium, sulfur and selenium. These elements all increase luminous efficiency and can be expected to further increase output in other versions of the single crystal (SC) sapphire lamp.

Figure 5:
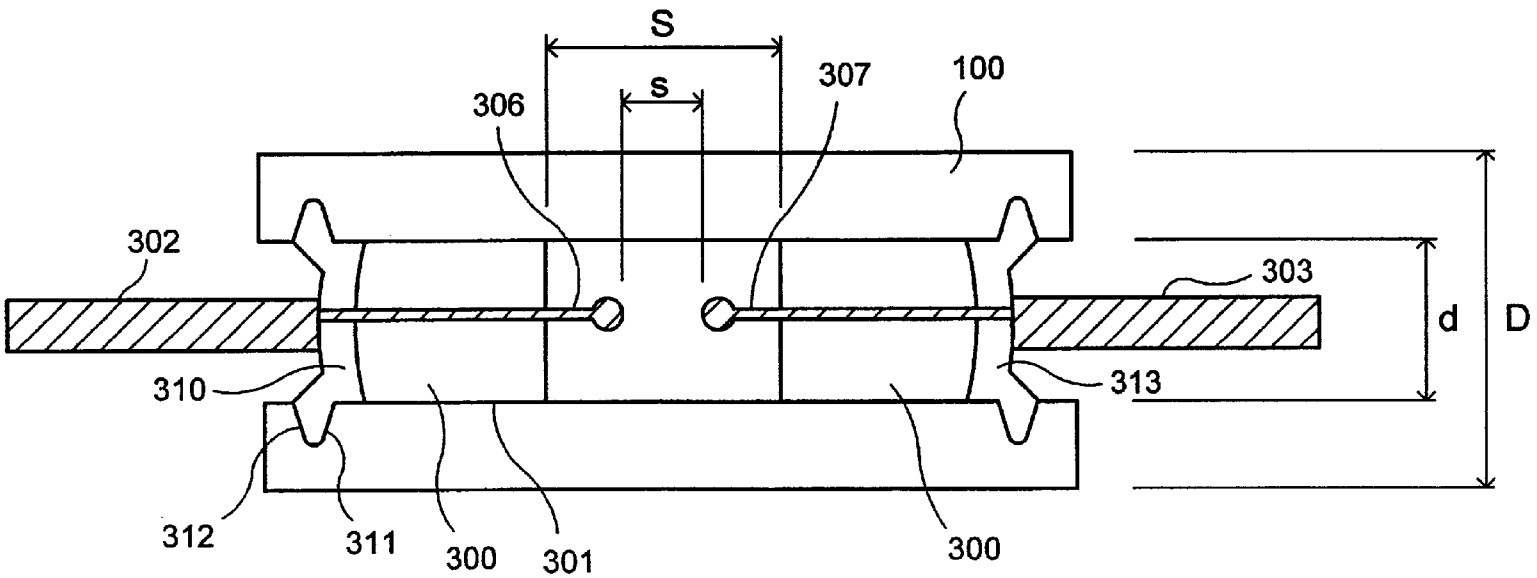
FIG. 5 is a cross-sectional view of a second embodiment of the bulb using electrodes.
Figure 6:
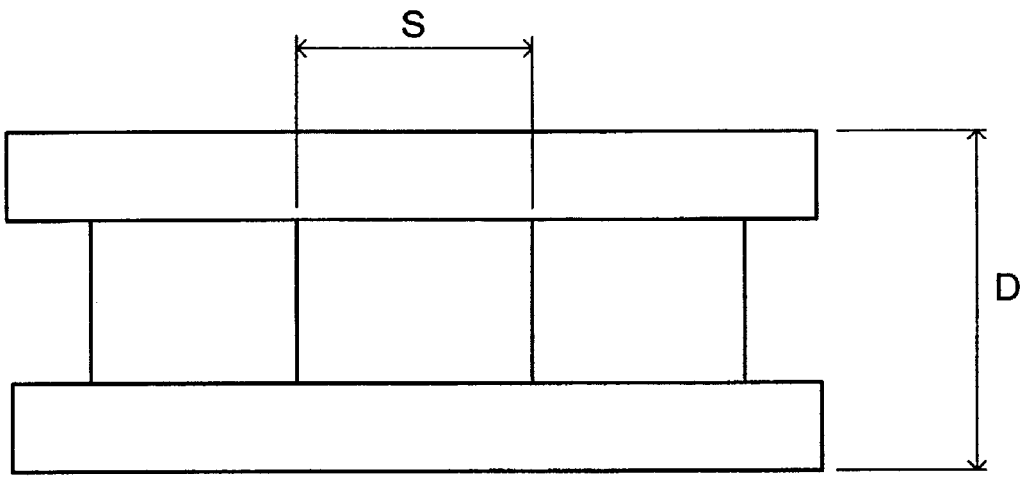
FIG. 6 is a cross-sectional view of a third embodiment of the bulb, which is without electrodes.

Larger lamps, which develop considerable pressure on the end plugs, can be built with the design shown in FIG. 5. In this figure a second, metallic barrier is built into the lamp. This second barrier utilizes a new seal geometry in which the pressure from the lamp is taken in compression on the seal face rather than in tension, as in the design in FIG. 2. FIG. 5 is a side cross-section of a single crystal (SC) sapphire high intensity halide lamp. In the case of FIG. 2, single crystal (SC) sapphire tube 100 is used and the two plugs 300 preferably are made of ceramic (polycrystalline) or single crystal (SC) sapphire to close the ends of the SC-sapphire tube 100 as a "first" seal. The plugs 300 are sealed to the single crystal (SC) sapphire tube 100 to form a pressure and chemical resistant seal and contain the gases inside the region bounded by the inside diameter d and the surface facing the discharge of the plugs 300. The plugs are sealed to the single crystal (SC) sapphire tube 100 with halide resistant glass 301 to form a pressure and chemical resistant seal and to contain the gases. The glass can be made from materials including aluminum, titanium or tungsten oxides available from commercial vendors such as Ferro Inc. of Cleveland. The melting point of such materials is chosen to be about 1300 degrees Celsius.

A "second" seal is provided in this design to further improve the lifetime of the lamps. A "cathode disc" is inserted in a groove in the tubing in such a way that the pressure on the ends is taken in compression by the single crystal (SC) sapphire tube, giving a more stable and pressure-resistant seal. The "first seal" takes the pressure in shear, and as bulb diameter increases the shear resistance of the seal does not scale with the diameter. The "second" seal being under compression can absorb much higher forces without flexing or tearing.

The second seal is preferably formed as follows. The cathode base 302 is welded into the cathode disc 310. The cathode stem 306 is also welded into the cathode disc 310 as shown. The cathode base 302 is composed of nickel or molybdenum. The cathode disc 310 is composed of niobium or tantalum which have coefficients of expansion close to that of single crystal (SC) sapphire ($8\times10^{-6}$ $K^{-1}$). The subassembly consisting of the cathode base 302, the cathode disc 310 and the cathode stem 306 is tapped into place. The cathode disc 310 is designed to be flexible enough to slip into the cathode seal receptacle 311. Upon assembly the lamp is first filled appropriately and then the cathode disc seal 312 is made with halide-resistant glass doped with titanium and tungsten.

Similarly, the anode end comprises an anode base 303 welded to anode disc 313 and anode stem 307. This new type of electrodeless lamp has advantages over the quartz technology in typical commercial electrodeless lamp applications. In particular, the high temperature capability of the envelope allows operation of the bulb at power densities much greater than 50 watts/cm 3 without rotation.

FIG. 7 is a side view cross-section of a single-crystal electrodeless high intensity halide lamp with a disc seal to allow higher pressure and longer life operation.

This design utilizes the disc seal concept described in FIG. 5, but only as a sealing device. This allows construction of a robust electrodeless lamp capable of operation at pressures over 300 atmospheres.

The electrodes shown in the drawings are adapted for A.C. operation. Their shape and size would be changed for D.C. or pulsed operation.

The lamps of the present invention may maintain a correlated color temperature of between 6500 and 7000 degrees Kelvin with continuous non-flash operation.

Preferably the lamp bulb envelope is cylindrical in shape, most preferably round-ring in shape, with an inner diameter d of between 1 mm and 25 mm and an outer diameter D of 4.8 or more. The fill emits uv or visible light; the fill density pressure is in excess of 10 mg/cm$^3$; the fill pressure preferably exceeds 20 atmospheres; the efficacy of light output exceeds 60 lumens/watt, and most preferably exceeds 75 lumens/watt; the inside surface of the bulb is adapted to be up to 1400 degrees Celsius; and the arc in the gap has a temperature of at least 1000 degrees Celsius.

What is claimed is:

1. A high intensity electrodeless lamp for producing visible light, comprising:

a lamp bulb envelope composed of a single crystal sapphire tubing, the tubing being substantially without surface undulations and being formed by heating alumina above its melting point, the lamp bulb envelope having a substantially cylindrical shape and having an inner diameter of between 1 mm and 25 mm and an outer diameter of at least 2 mm, an inside wall of the lamp bulb envelope having a first grove proximate a first end of the lamp bulb envelope and a second end thereof opposite the first end; and two end sealing plates being composed of one of niobium and tantalum, each of the plates being fitted into a corresponding one of the first and second grooves, wherein a length of the lamp bulb envelope is such that it fits into a microwave cavity with the end sealing plates near opposite ends of the cavity, and wherein one of microwaves and energy is guided around the end sealing plates.

2. A high intensity discharge lamp, comprising:

(a) a lamp bulb envelope tube composed of a single crystal sapphire tubing, the tubing having a tubular burst pressure in excess of 4,500 psi at 1,400° C. and a maximum tensile strength of 56,000 psi at 1,400° C., the lamp bulb envelope having a cylindrical shape and having an inner diameter of between 1 mm and 25 mm and an outer diameter of at least 2 mm;

(b) first and second electrodes situated within the lamp bulb envelope; and (c) a fill situated within the lamp bulb envelope, the fill emitting at least one of uv and visible light having a color temperature between 6,500 and 7,0000 Kelvin when an arc is struck between the first and second electrodes, wherein pressure of the fill exceeds 120 atmospheres, and wherein an effective correlated color temperature is maintained in a continuous non-flash operation.

3. The lamp according to claim 2, wherein the lamp is operated in the non-flash continuous mode and wherein the correlated color temperature is maintained at a predetermined value to increase a lamp apparent efficacy value above 60 lumens/watt, the predetermined value corresponding to a particular application of the lamp.

4. The lamp according to claim 3, wherein the efficacy exceeds 75 lumens/watt.

5. The lamp according to claim 2, wherein the first and second electrodes are separated by a predetermined distance, the predetermined distance being less than 2 mm.

6. The lamp according to claim 2, wherein the conduction heat flux to the inside of the lamp bulb envelope exceeds 150 watts/cm^2.

7. The lamp according to claim 2, wherein the conduction heat flux to the inside of the lamp bulb envelope is between 100 and 150 watts/cm^2.

* * * * *